US005873744A

United States Patent [19]

Ramos, Jr.

[11] Patent Number: 5,873,744

[45] Date of Patent: Feb. 23, 1999

[54] ELECTRICAL CONNECTOR ASSEMBLY

[76] Inventor: Phillip M. Ramos, Jr., 1023 S. Taylor Ct., Anaheim, Calif. 92808

[21] Appl. No.: 799,151

[22] Filed: Feb. 18, 1997

[51] Int. Cl.[6] ..... H01R 13/44

[52] U.S. Cl. ..... 439/144; 439/936

[58] Field of Search ..... 439/144, 371, 439/936, 677, 678, 680

[56] References Cited

U.S. PATENT DOCUMENTS

| | | | |
|---|---|---|---|
| 2,496,208 | 1/1950 | Hasselbaum | 439/144 |
| 4,072,381 | 2/1978 | Burkhart et al. | 439/144 |
| 4,154,495 | 5/1979 | Crewse | 439/144 |
| 4,245,875 | 1/1981 | Shaffer et al. | 439/144 |
| 5,302,141 | 4/1994 | O'Reilly et al. | 439/144 |

*Primary Examiner*—Gary F. Paumen
*Attorney, Agent, or Firm*—Richard Slehofer

[57] ABSTRACT

An electrical connector is provided which includes a plug and a socket, and in which the plug is latched to the socket after the plug has been inserted into the socket to maintain the electric contacts of the plug and socket in contact with one another, and which includes an abrasive affixed to at least one of the latching surfaces to increase the pull force required to separate the plug and socket when in a latched condition.

5 Claims, 1 Drawing Sheet

ELECTRICAL CONNECTOR ASSEMBLY

BACKGROUND OF THE INVENTION

The invention is concerned with electrical connectors and particularly, although not exclusively, with electrical connectors which are used in the trucking industry for interconnecting tractor-trailer jumper cables.

Seven-conductor electrical connectors for tractor-trailer jumper cables have become a standard item in the trucking industry. These connectors are subject to SAE standards, such as SAE Standard J560. The jumper cables themselves are also subject to SAE standards, such as SAE Standard J1067.

Originally the housings of the connectors were constructed of an appropriate metal. However, there has been a trend in recent years to make the connector housings out of plastic. Problems have arisen, however, especially in the case of the plastic housings, in that it has been found that under extreme conditions, there is a tendency for the plug and socket of the electrical connectors to pull apart when in a latched condition. This can create a hazardous condition, since it immediately causes all electric power to the trailer to be disconnected.

An electrical connector, such as referred to above, is disclosed, for example, in U.S. Pat. No. 4,786,261, which issued Nov. 22, 1988 in the name of the present inventor. Other similar connectors for tractor-trailer use are described, for example, in U.S. Pat. Nos. 4,072,381 and 4,304,457. All of the connectors referred to above include a plug which is connected to appropriate jumper cables, and a socket which is mounted on the tractor cab. After the plug has been plugged into the socket, the plug and socket are latched together by an appropriate latch formed on the cover of the socket.

As mentioned above, although the latching assembly provides an adequate lock between the plug and socket under normal conditions, it has been found that there is a tendency for the plug to pull out from the socket under some conditions. An objective of the present invention is to provide a simple and inexpensive construction which overcomes that problem.

BRIEF SUMMARY OF THE INVENTION

The invention is concerned with a means for preventing plugs and sockets from becoming unlatched under certain load conditions. This means comprises forming an abrasive coating on the latch, and the resulting increased frictional engagement of the latch is such that any tendency for the plug and socket to pull apart under the latched condition is obviated.

DETAILED DESCRIPTION OF THE ILLUSTRATED EMBODIMENT

Figure 1:
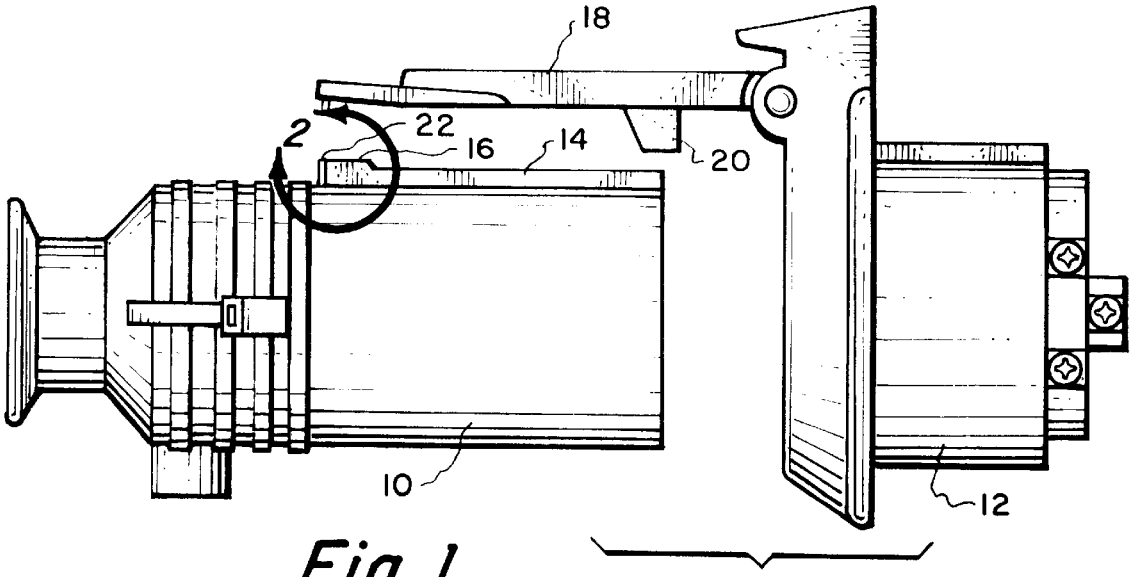
FIG. 1 is a side view of a typical electrical connector of the type described above which includes a latch whose latching surface is treated in accordance with the teaching of the invention.
Figure 2:
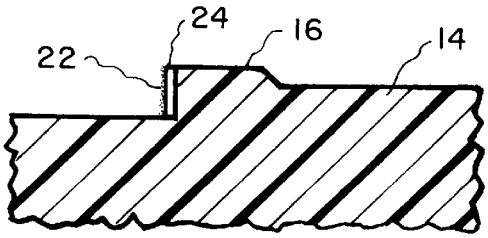
FIG. 2 is an enlarged view of the area designated 2 in FIG. 1.

The connector of the present invention is a typical seven-conductor electrical connector for tractor-trailer jumper cables, and it includes a plug 10 which is mounted on one end of the connecting cable, and a socket 12 which is mounted on a tractor cab, trailer or other towed equipment. The socket 12 has a number of male contact pins (for example, seven), and the plug 10 has a corresponding number of female contact pins. The female contact pins in the plug receive the male contact pins of the socket when the plug is plugged into the socket. This provides electrical connection between the pins in the plug and socket.

The socket 12 is usually equipped with a cover 18 which is hinged to the forward end of the socket and which may be closed when the socket is not in use so as to protect the contact pins and interior of the socket.

A latching member 20 is formed on the bottom of the cover 18 which serves to latch the plug to the socket when the plug is inserted into the socket after the cover has been opened. A longitudinal key 14 is provided on the exterior surface of the plug, and this key is received in a mating keyway in the socket when the plug is plugged into the socket. The end of key 14 forms a stop 16 which engages the latching member 20 when the plug is plugged into the socket.

Although the latching assembly described above provides an adequate lock between the plug and the socket under normal conditions, it has been found, as stated above, that there is a tendency for the plug to come loose from the socket under certain extreme conditions. This hazard is overcome in accordance with the teaching of the invention by providing an abrasive coating 22 on the end of stop 16, or on the latch 20, or on both latching surfaces. This abrasive coating 22 may be formed, for example, of Boron Carbide powder of mesh size 10. Such powder may be obtained, for example, from the ALYN Corporation, 2925 College Avenue, Costa Mesa, Calif. 92626.

The abrasive coating 22 is adhesively attached to the face of stop 16 by an appropriate adhesive 24. A suitable adhesive has been found to be #M Scotch-Weld Epoxy Adhesive 2216 B/A.

It has been found that connectors constructed in accordance with the teaching of the invention completely overcome any tendency for the plug to pull out of the socket under latched conditions, even for extreme pulling forces.

The following table illustrates the pull forces required to detach a connector constructed in accordance with the invention, as compared with the prior art connectors, when under a latched condition. The tests which resulted in the results set forth below were made by an independent testing facility, namely, Truesdail Laboratories, Inc., 14201 Franklin Avenue, Tustin, Calif. 92680.

TEST DATA/OBSERVATIONS: TYPICAL TEST

| Plug | Pull Force Latched - in Pounds |
|---|---|
| Competitor A | 38.0 |
| Competitor B | 40.5 |
| Competitor C | 35.0 |
| Competitor D | 43.5 |
| Competitor E | 41.5 |
| Competitor F | 93.0 |
| Constructed in Accordance with Invention | 340.0 |

The invention provides, therefore, a new and improved connector which is capable of withstanding high forces and yet retain its latched condition.

It will be appreciated that while a particular embodiment of the invention has been shown and described, modifications may be made. It is intended in the following claims to cover all such modifications which fall within the true spirit and scope of the invention.

I claim:

1. An electrical connector for use in a tractor-trailer comprising:

a plug member and a socket member each containing electric contacts which engage one another when said plug member is inserted into said socket members;

said plug member having an exterior surface and a stop with an engaging surface formed on said exterior surfaces;

said socket member having a latch with an engaging surface hinged to said socket member which engages said stop in a latched engagement after said plug member has been plugged into said socket member;

said engaging surface of at least one of said stop and latch has an abrasive thereon to increase the pull force necessary to separate said plug member from said socket member when said plug member and said socket member are in a latched condition.

2. The electrical connector defined in claim 1, in which said abrasive is a powder attached to the engaging surface by an adhesive.

3. The electrical connector defined in claim 2, in which said powder has a grain size of #10.

4. The electrical connector defined in claim 2, in which said powder is a Boron Carbide abrasive.

5. The electrical connector defined in claim 2, in which said adhesive is an epoxy adhesive.

* * * * *